United States Patent [19]

Brown

[11] 3,975,021

[45] Aug. 17, 1976

[54] EDUCATIONAL DEVICE EMPLOYING A GAME SITUATION

[76] Inventor: Melbourne Thomas Brown, 1825 E. Gaviota Court, Simi Valley, Calif. 93065

[22] Filed: Dec. 30, 1974

[21] Appl. No.: 537,363

[52] U.S. Cl. ..... 273/135 B; 273/135 AC; 35/31 F

[51] Int. Cl.[2] ..... A63F 3/06

[58] Field of Search ..... 273/135 R, 135 B, 130 R, 273/135 AA, 135 AC, 135 D, 130 E, 130 H; 35/31 R, 31 D, 31 F

[56] References Cited

UNITED STATES PATENTS

| | | | |
|---|---|---|---|
| 957,800 | 5/1910 | Richardson | 273/135 B |
| 1,402,807 | 1/1922 | Tegtmeyer | 273/135 B |
| 1,624,450 | 4/1927 | Vershbinsky | 35/31 D |
| 1,871,247 | 8/1932 | Trost | 273/135 B |
| 1,946,318 | 2/1934 | Hamilton | 35/31 D |
| 3,545,101 | 8/1970 | Fike | 35/31 F |
| 3,549,150 | 12/1970 | Weeks | 273/135 B |

*Primary Examiner*—Anton O. Oechsle
*Assistant Examiner*—Harry G. Strappello
*Attorney, Agent, or Firm*—Lyon & Lyon

[57] ABSTRACT

A novel educational device that employs a game situation to teach various relationships of numbers. The educational device is generally comprised of a playing board having a plurality of contiguous areas, each area containing a different main number and also containing secondary indicia, a plurality of markers, and a chance device for determining upon which of the contiguous areas the markers may be placed. The concepts of factoring, prime numbers, and square roots are also involved in the game situation. The object of the game is to place a predetermined number of markers in a row to obtain a score equal to the sum of the main numbers covered in such row.

8 Claims, 4 Drawing Figures

EDUCATIONAL DEVICE EMPLOYING A GAME SITUATION

FIELD OF THE INVENTION

This invention relates to educational devices, and more particularly to an educational device employing a game situation to teach various relationships of numbers.

DESCRIPTION OF THE PRIOR ART

Educational devices for teaching mathematics have been in use for a great number of years. In most cases, such prior art educational devices employed rather complex means for teaching either addition, subtraction, multiplication, or division. In some cases, overlays having various openings therein were located above number boards, and such overlays were manipulated to obtain the desired results. In one case, a frame having slidable rods was combined with light emitting means to teach the multiplication tables. For the most part, such educational devices were expensive and taught only one mathematical operation.

Furthermore, such prior art educational devices were primarily for educational purposes and were operated by only one person at a time. Such devices usually did not provide entertainment, nor did they provide competition between various persons. Thus, for the most part, children quickly became bored with such devices.

Accordingly, it is an object of the present invention to provide an educational device employing a game situation to teach various relationships of numbers.

It is a further object of the present invention to provide a game apparatus that is not only entertaining, but is also educational.

It is a still further object of the present invention to provide a game apparatus for teaching attributes of various numbers.

It is another object of the present invention to provide an educational device allowing for competition between two or more persons.

It is still another object of the present invention to provide an educational device that is inexpensively constructed.

It is yet another object of the present invention to provide a game apparatus that will hold the interest of children over a long period of time while they are learning mathematics.

SUMMARY OF THE INVENTION

In accordance with the objects set forth above, this invention provides an educational device that employs a game situation to teach various relationships of numbers. The educational device is generally comprised of a playing board having a plurality of contiguous areas located thereon, a plurality of markers, and chance means that may be sequentially operated by players of the educational device. Each of such contiguous areas contains a different main number and the majority of the contiguous areas also contains at least one or more numbers that may be divided into the respective main numbers.

Prime numbers and main numbers in which the square roots may be taken to obtain other main numbers are enclosed by circles and rectangles, respectively. Color coding is also provided for those main numbers which also appear frequently in other areas as numbers related to the respective main numbers of such areas. In the operation of the educational device, players operate the chance means to determine which of said plurality of contiguous areas that they may place a marker to either obtain a predetermined number of markers in a row. The first player to obtain such predetermined number in a row receives a score equal to the sum of the main number he has covered in such row.

BRIEF DESCRIPTION OF THE DRAWINGS

Additional objects, advantages and characteristic features of the present invention will become readily apparent from the following description of the preferred embodiments of the invention when taken in conjunction with the accompanying drawings in which.

DESCRIPTION OF THE PREFERRED EMBODIMENTS

Figure 1:
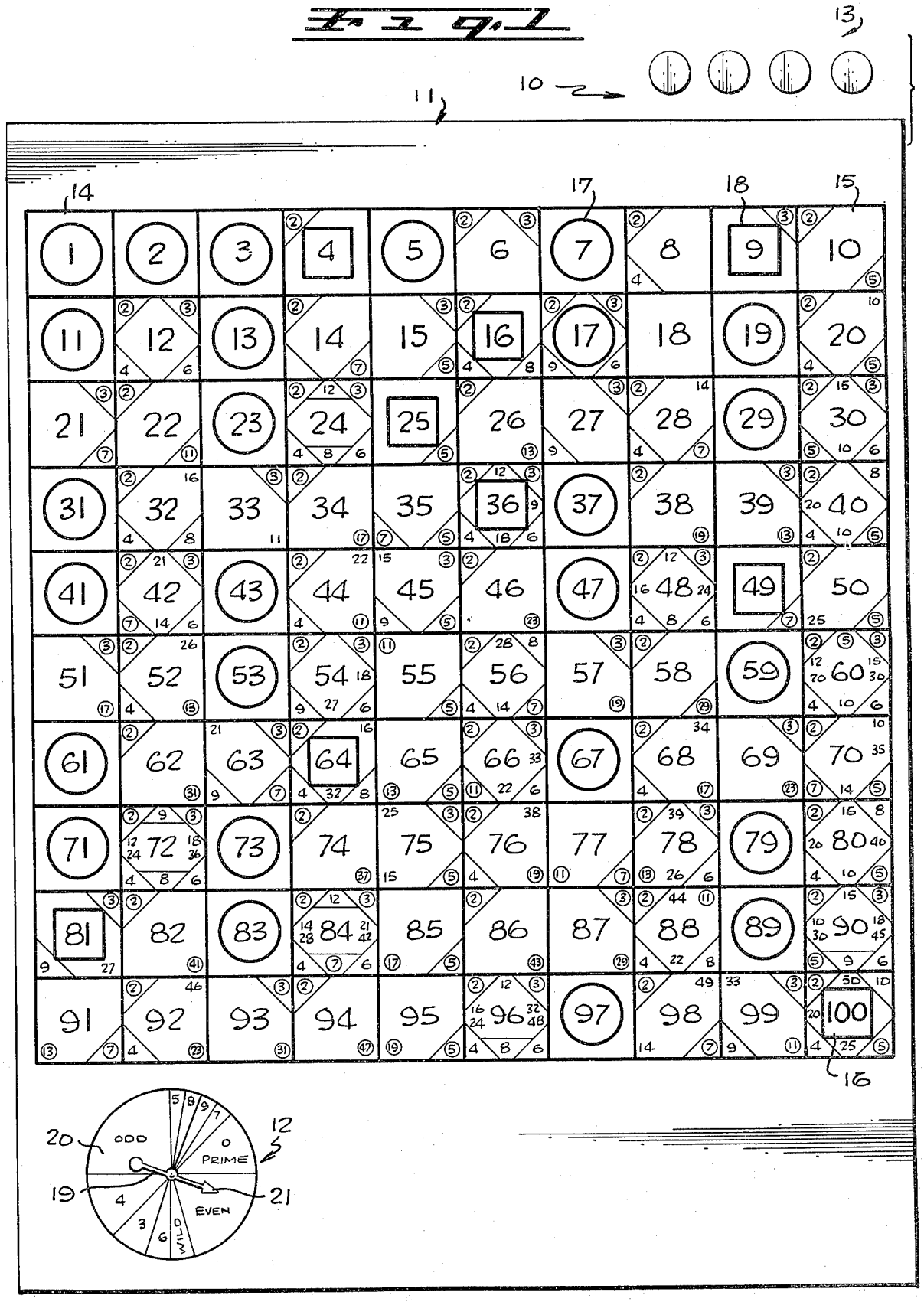
FIG. 1 is a top plan view of a game apparatus in accordance with the present invention.

Referring now to FIG. 1, there is shown a top plan view of a game apparatus 10 in accordance with the principles of the present invention. The game apparatus 10 is generally comprised of a number board 11, chance means 12, and a plurality of markers 13. While the chance means 12 are shown as part of the same structure as the number board 11, it should be understood that the chance means 12 may be constructed as a separate unit of the game apparatus 10. The number board 11 may be fabricated of any suitable material, such as, paper, cardboard, or plastic, or it may be a lamination of one or more suitable materials. The area to the right of the chance means 12 may be utilized to set forth the instructions for the game if so desired.

As shown in FIG. 1, the number board 11 is comprised of a plurality of contiguous areas, namely, ten rows of areas, with each row having ten areas. Preferably, all of the areas are square and of the same size so that the markers may be placed in rows as will be discussed later in the specification. Each of the areas contains a different main number, for example, the first area of the top row, the area on the upper left corner of the number board 11, designated area 14, contains the main number one. Each succeeding area to the right of the area 14 contains a main number which is one number higher in value than the main number of its respective preceding area, and the last area in the top row, designated area 14, contains the main number ten. Each succeeding row of the number board 11 includes a respective first area, located on the left side of the number board 11, which contains a respective main number that is one number higher in value than the respective main number of the last area of the respective immediate above row. As in the top row of the number board 11, each succeeding area to the right of the first area of a row contains a respective main number that is one number higher in value than the main number of its respective preceding area. Such a relationship continues until the area, on the lower right corner of the number board 11, designated area 16, containing the main number one hundred is reached.

As further shown in FIG. 1, a majority of the areas include one or more combinations of numbers in addition to the respective main numbers of such areas. The purpose of such combinations of numbers is to identify which main numbers may be factored by at least one combination of numbers other than the combination of a respective main number with the number one and how those main numbers can be factored. For example, the area containing the main number eight also contains the number two and the number four, and the area containing the main number 18 also contains the number two, the number nine, the number three, and the number six. All such numbers contained within such areas are smaller in physical dimension than the respective main numbers of such areas. Thus, the player, either a child or an adult, may look at any one of such areas, and may readily ascertain the combination, or combinations, of numbers that may be divided into the respective main number of that particular area.

Another feature of the number board 11 is that the player may readily ascertain which of the main numbers are prime numbers, i.e., which of the main numbers may be divided only by themselves and the number one. All of the main numbers which are prime numbers are enclosed by a circle. For example, the main number seven is enclosed by a circle designated by the numeral 17. Thus, after playing the game for a period of time, the player is not only entertained, but also begins to appreciate the concept of prime numbers.

Further illustrated in FIG. 1 is the feature of identifying all of the main numbers in which the square root may be taken to obtain a whole number. All such main numbers are enclosed by squares, e.g., the main number nine is enclosed by a square designated by the number 18. Thus, as in the case of prime numbers, the player may readily ascertain another attribute of various numbers.

Figure 2:
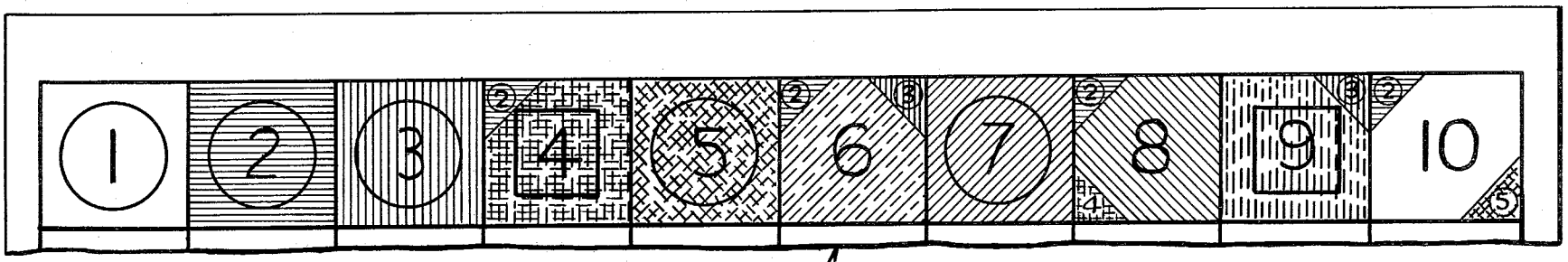
FIG. 2 is an exploded top plan view of a portion of the number board of the game apparatus of FIG. 1 in accordance with the present invention.
Figure 3:
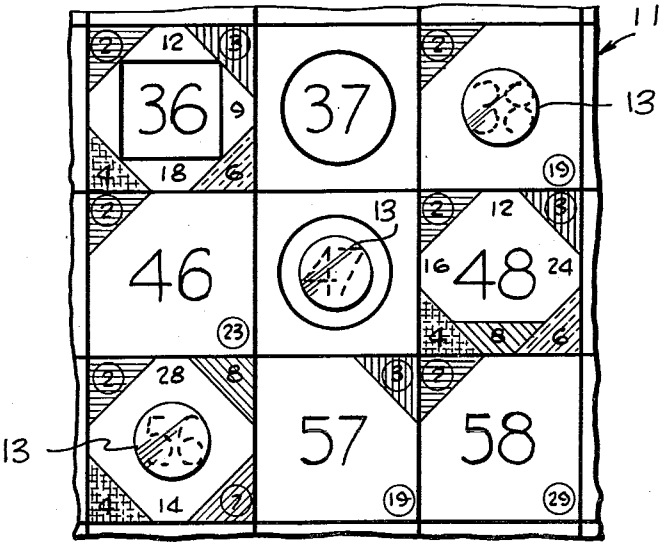
FIG. 3 is an exploded top plan view of another portion of the number board of the game apparatus of FIG. 1 in accordance with the present invention.

Referring now to FIG. 2, there is shown an exploded top plan view of the top row of the number board 11 of FIG. 1 in accordance with the principles of the present invention. As illustrated, the main numbers two through nine are color coded to provide a further means identifying such main numbers. As also shown in FIG. 3, when the numbers two through nine appear in other areas of the number board 11, such numbers appear with respective coloring corresponding to the coloring of the main numbers two through nine. It should be understood that the size of the areas illustrated in FIG. 1 does not permit such color coding to be shown throughout the entire number board 11 of FIG. 1; however, fabricated number boards of the type illustrated in FIG. 1 would be colored throughout in accordance with the color coding set forth in FIG. 2 and FIG. 3.

Figure 4:
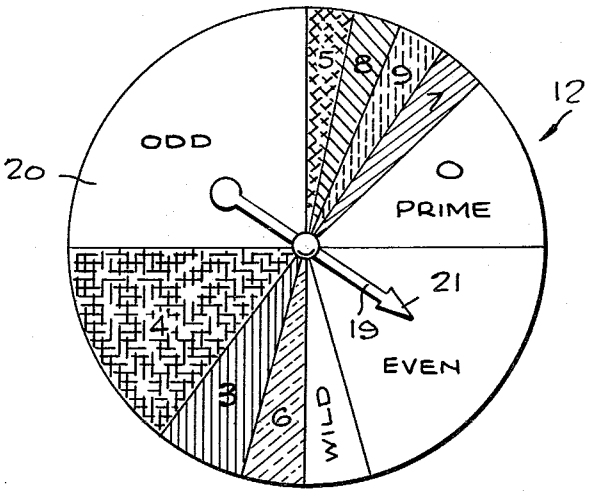
FIG. 4 is an exploded top plan view of the chance means of the game apparatus of FIG. 1 in accordance with the present invention.

Referring now to FIG. 4, there is shown an exploded top plan view of the chance means 12 of FIG. 1 in accordance with the principles of the present invention. The chance means 12 is generally comprised of a spinner 19 and a dial 20. The spinner 19 may be rotatably mounted by any suitable conventional means to the center of the dial 20. The dial 20 is separated into a plurality of sections, with each section having different information contained thereon. The numbers set forth on the dial 20 are color coded in accordance with the color coding set forth in FIG. 2.

Before starting to play the game apparatus 10, the plurality of markers 13 are divided between the players. As is obvious, the maximum number of useful markers that may be distributed for a game is 100. Each player receives a number of markers that are distinguishable from the markers received by the other players. For example, the markers may be of different colors or the markers may be distinguishable by other means, for example, letters. Two or more players may play the game against each other, or the players may be divided into teams to provide team competition.

The object of the game is to place a defined number of your markers in a row, either vertically, horizontally, or diagonally, in such a manner that the sum of the main numbers covered by the defined number of markers is of the highest possible value. For example, if a player had to place four markers in a row in order to score, the highest score that he could attain would be 394 points by placing a marker on each one of the last four areas of the bottom row of the number board 11. At that time, all of the markers would be returned to the players, and play would continue as each player would attempt to score before his opponents scored. This procedure would continue until a player scored a predetermined number of points, for example, 1,000 points, to win the game. If the players desired to have the competition continue over a longer period of time, the ultimate winner may be that player who wins three games. Of course, a player may also play defensively by placing a marker within the path of a row of markers of his opponent.

Referring now again to FIG. 4, the chance means 12 may be utilized to determine the order of play among the players. For example, the player who spins the spinner 19 and lands the arrow 21 on the highest number would be the player who takes the first turn during the game. The player with the next highest number would be next in the rotation, and so forth. It is obvious that there may be additional sections on the dial 20, for example, there may be a section with the number two or a section for the main numbers in which the square root may be taken to obtain a whole number. During a game, if the arrow 21 lands within one of the sections marked three through nine, a player may place a marker on the area containing the main number corresponding to the number upon which the arrow has landed, or a marker may be placed on any area which includes such number as a factor of the main number of that area. For example, if the arrow lands on the number eight, the player may place a marker on the area of the main number eight in the first row of the number board 11, or may place a marker on one of a number of other areas, including the area containing main number 56, as shown in FIG. 3. Landing the arrow 21 within the section designated "even" allows a marker to be placed on any even numbered main number, and landing the arrow 21 within the section designated "odd" allows a marker to be placed on any odd numbered main number. By the same token, placing the arrow 21 within the section designated "prime" allows a marker to be placed on any area containing a prime main number. Of course, landing the arrow 21 within the section designated "wild" allows a marker to be placed on any main number.

As may now be appreciated, the game apparatus 11 is an educational device that not only provides entertainment, but also imparts a better understanding of mathematics to the players. In playing the game, the younger students will learn the attributes of various numbers and will not become bored as they do in many present day classroom situations. The color coding allows preschool age children to play the game, and at the same time, they will become familiar with numbers. By the time the children enter school, they will not be afraid of mathematics as many children are in this present day.

Thus, although the present invention has been shown and described with reference to particular embodiments, for example, a number which is square and includes 100 main numbers, various changes and modifications obvious to a person skilled in the art to which this invention pertains, for example, a number board which is round and includes more or less than one hundred main numbers, are deemed to lie within the spirit, scope and contemplation of the invention as set forth in the appended claims.

What is claimed is:

1. A game apparatus for teaching the relationship of numbers comprising:

a. A playing board including:

i. a plurality of contiguous areas;

ii. a like plurality of main numbers, each said main number having a value different than any other of said main numbers, and each of said main numbers being located within a different one of said plurality of contiguous areas; and iii. secondary indicia means located in each of said contiguous areas for respectively identifying factors of said main numbers;

b. a plurality of markers; and c. chance means operable in turn by players of said game apparatus for determining placement of markers upon selected ones of said contiguous areas, said chance means having a plurality of differing indicia means thereon, certain ones of said differing indicia means corresponding identically to certain ones of said main numbers and to certain ones of said secondary indicia means, each of said differing indicia means having a mathematical relationship with more than one of said areas, said relationships defining the contiguous areas wherein said respective players may place a marker per turn.

2. The combination of claim 1 wherein said secondary indicia means located within a respective contiguous area include numbers corresponding identically to whole number factors of the main numbers located within said respective area and means for indicating those main numbers divisible solely by themselves and the number one.

3. The combination of claim 1 wherein said plurality of contiguous areas is equal to a finite number of delineated areas aligned in a finite number of rows, the first delineated area of the first row having a main number located therein, each succeeding delineated area of said first row having a main number one higher than its respective preceeding main number, the first delineated area of each succeeding row having a respective main number one higher than the main number of the last delineated area of the preceeding row, and each succeeding delineated area of each respective succeeding row having a main number one higher than its respective preceeding delineated area.

4. The combination of claim 2 including means on certain of said contiguous areas for identifying those main numbers the square roots of which are whole numbers.

5. The combination of claim 3 wherein said finite number of delineated areas is equal to 100, said finite number of rows is equal to 10, and each row includes 10 main numbers.

6. The combination of claim 5 wherein said first main number of said first row is the number one, and the last main number of said 10th row is the number 100.

7. The combination of claim 6 wherein the main numbers two through nine of said first row are further identified by respective different colors.

8. The combination of claim 7 wherein said secondary indicia means includes any one of the numbers two through nine, said numbers being respectively identified by colors corresponding identically to said colors identifying said main numbers two through nine, respectively.

* * * * *